United States Patent [19]

von Röpenack et al.

[11] 4,364,807

[45] Dec. 21, 1982

[54] METHOD OF ELECTROLYTICALLY RECOVERING ZINC

[75] Inventors: Adolf von Röpenack; Günter Stock, both of Datteln; Ulrich Heubner, Bad Homburg, all of Fed. Rep. of Germany

[73] Assignee: Ruhr Zink GmbH, Datteln, Fed. Rep. of Germany

[21] Appl. No.: 233,491

[22] Filed: Feb. 11, 1981

[30] Foreign Application Priority Data

Feb. 15, 1980 [DE] Fed. Rep. of Germany ..... 3005674

[51] Int. Cl.[3] ..... C25B 11/03; C25C 1/16

[52] U.S. Cl. ..... 204/114; 204/119; 204/293

[58] Field of Search ..... 204/293, 242, 280, 114, 204/119

[56] References Cited

U.S. PATENT DOCUMENTS 4,272,339 6/1981 Knight et al. ..... 204/293

FOREIGN PATENT DOCUMENTS 692820 1/1951 United Kingdom .
473756 8/1973 U.S.S.R. .

OTHER PUBLICATIONS

Chemical Abstracts, vol. 82, No. 20, May 19, 1975, Columbus, Ohio, USA (G. S. Kiryakov, "Prospective Improvements in Lead-Based Anodes", p. 398, col. 1, Abstract 130938r).

Chemical Abstracts, vol. 84, No. 16, Apr. 19, 1976, Columbus, Ohio, USA (G. Z. Kiryakov, "Lead Alloy", p. 293, col. 1, Abstract 110019e).

The Journal of Applied Chemistry of the USSR, vol. 24 II, 1951, pp. 1429-1439, (English translation), "Stability of Anodes of Lead . . . ", by G. Z. Kiryakov and V. V. Stender.

The Journal of Applied Chemistry of the USSR vol. 24, II, 1951, pp. 1429-139 (English translation) "Stability of Anodes of Lead . . . by G. Z. Kiryakov and V. V. Stender.

The Journal of Applied Chemistry in the USSR vol. 26I, 1953, pp. 847-849 (English translation) I. A. "Role of Lead Dioxide Films . . . " by G. Z. Kiryakov and Korchmarek Blei und Bleilegierungen by Wilhelm Hofmann Germany, 1952, Springer-Verlag, pp. 285-288.

*Primary Examiner*—R. L. Andrews
*Attorney, Agent, or Firm*—Karl F. Ross

[57] ABSTRACT

A lead alloy anode for a cell for the electrowinning or electrolytic recovery of zinc consists of 0.05 to 0.25% by weight strontium and/or 0.05 to 0.1% by calcium in combination with 0.1 to 0.5 silver, balance lead. The cell is used in a method for the recovery of zinc at, for example, a current density of 160 to 630 amp/m$^2$, a temperature of 30° to 46° C. and an electrolyte containing 40 to 70 g/l zinc and 165 to 220 g/l sulfuric acid.

3 Claims, 1 Drawing Figure

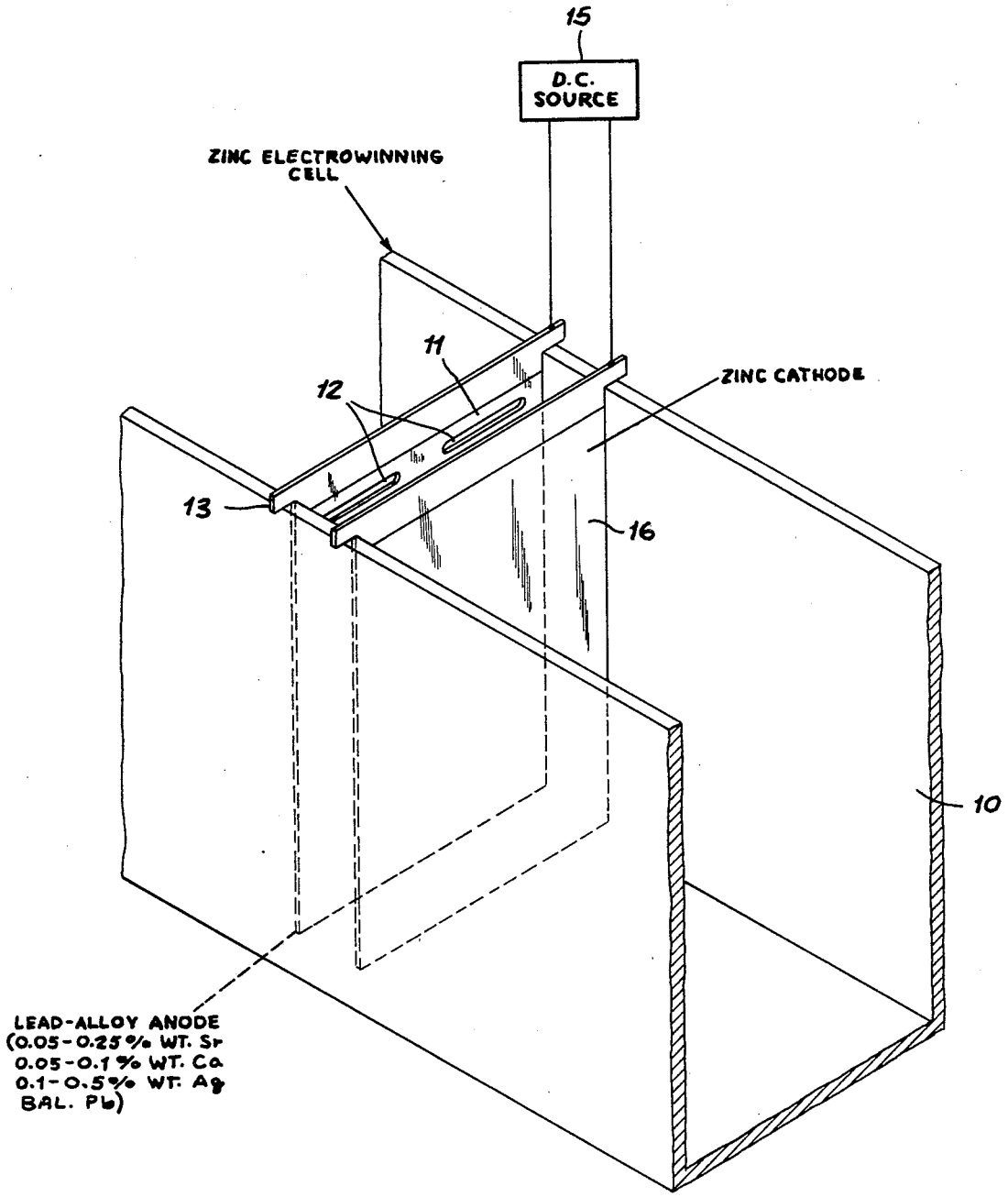
15
D.C. SOURCE
ZINC ELECTROWINNING CELL
11
12
ZINC CATHODE
13
16
10
LEAD-ALLOY ANODE
(0.05-0.25% WT. Sr
0.05-0.1% WT. Ca
0.1-0.5% WT. Ag
BAL. Pb)

METHOD OF ELECTROLYTICALLY RECOVERING ZINC

FIELD OF THE INVENTION

Our present invention relates to the electrolytic recovery or electrowinning of zinc utilizing electrolytic cells with anodes containing lead.

BACKGROUND OF THE INVENTION

In the hydrometallurgical extraction of zinc from zinc-containing metallurgical ore, usually zinc blende, is roasted to produce a calcine which is leached with acid, the solution being purified and used as an electrolyte for the electolytic deposition or electrowinning of the zinc from the solution. The zinc, which is deposited on the cathode, is removed and remelted.

In the past the electrowinning step has generally been carried out with electrolytes which, for the most part, consist of sulfuric acid solutions in which the zinc is dissolved, the anodes of the electrolytic cells being composed of lead, the cathodes of aluminum.

Lead anodes are composed of anode materials which generally have been ternary lead alloys containing 0.5 to 1.0% by weight silver and a small amount of a third component in addition to lead which makes up the balance of the alloy.

In the *Journal of Applied Chemistry of the USSR,* Vol. 25 (1951) p. 429 ff., investigations of certain elements as the third component have been described. These elements are thallium, tellurium, selenium, bismuth, calcium, gold, mercury, strontium, barium, arsenic, tin and cobalt. In volume 25 (1953) p. 847 ff. of the *Journal,* the use of magnesium and silicon as the third component has been discussed.

Notwithstanding the considerable research which has been undertaken in the past to develop a satisfactory alloy for use as the anode material in the electrowinning of zinc, experience has shown that earlier anode materials suffer significant weight loss during the electrolysis. This weight loss is an indication of the rapid consumption of the anode material and contributes to the formation of slime in substantial quantities of the zinc deposited at the cathode.

Furthermore, the earlier anode materials suffer from the fact that they lack requisite mechanical strength or, where they originally possess sufficient strength, tend to lose it during use. This diminution of the strength of the anode can result in warping and, where the anode and cathode are closely juxtaposed, to short-circuiting and arcing. Even where short-circuiting and arcing do not occur, there is the danger that the current distribution across the cathode may be affected by the warping, thereby causing nonuniform deposition.

From *Blei und Bleilegierungen,* Springer-Verlag 1962, p. 285 ff., W. Hofmann, one must draw the conclusion that the use of alloying components in lead anodes gives rise to inconsistent phenomena or effects which cannot be predicted. Also, the alloying ingredients are extremely expensive and their use may be contraindicated simply because of the cost factor. In this regard, it should be borne in mind that an average plant may utilize lead alloys for anode materials in amounts of a thousand metric tons or more in the electrodeposition tank shed.

OBJECTS OF THE INVENTION

An object of the invention is to provide an improved method of electrowinning zinc from sulfuric acid electrolytes which reduces the need for expensive anode materials which have a tendency to warp and to suffer severe weight loss.

SUMMARY OF THE INVENTION

These objects and others which will become apparent hereinafter are attained, in accordance with the present invention by the use as the anode material for the anode of an electrolytic cell for the electrowinning of zinc from acid solutions, especially sulfuric acid electrolytes, material which consists essentially of at least one element selected from the group which consists of 0.05 to 0.25% by weight strontium and/or 0.05 to 0.1% by weight calcium, together with 0.1 to 0.5% by weight silver, the balance lead.

According to a feature of the invention, the alloy contains strontium in an amount of 0.05 to 0.1%. Thus, when the alloy contains both calcium and strontium, the total amount of the two can range between 0.1% by weight to 0.2% by weight.

Anodes made from alloys of the composition of the present invention have significantly higher hardness than earlier alloys as well as high elasticity and thus are dimensionally stable in smaller thicknesses than conventional anodes.

There is, therefore, a saving in the total anode weight and specifically in the alloying ingredients and particularly the silver, thereby markedly reducing the cost.

Since less massive anodes may be used, the carrying bars may be of reduced weight as well, thereby reducing the structural requirements of the entire cell system.

Another important advantage of the present invention is that the high dimensional stability of the anodes of this invention allows the electrode spacing to be decreased over conventional cell constructions, thereby reducing energy consumption and increasing the spatial efficiency of zinc recovery.

It is possible in accordance with the present invention to provide ternary alloys in which the third component is either calcium or strontium in the proportions set forth although a quaternary alloy containing both calcium and strontium in the indicated proportions is equivalent in properties.

The anodes of the present invention can be fabricated by casting into the final shape or by forming a billet of the alloy by a conventional casting process and rolling it to the desired shape. When the anodes are formed in their final shape and dimensions by casting, openings can be provided therein for the passage of electrolyte. Surprisingly, the alloy is of such high strength that even with the presence of such openings, the anode has sufficient dimensional stability that its thickness need not be increased by reason of the presence of the openings.

Cast anodes are generally of greater hardness than rolled anodes, and we have found that it is desirable to cool the cast anodes slowly (over a period of hours) after casting so as to enable them to reach optimum hardness. The slow cooling appears to increase the hardness and the resistance of the anode to corrosion as well (by comparison with fast cooling).

Tests have shown that the corrosion resistance of the anodes of the present invention is so great that they can be used for months with virtually no loss of material, a truly surprising phenomenon since one would normally be led to believe that the reduced silver content of the anodes of the present invention would lead to a reduction in the corrosion resistance and, conversely, to increased material loss with the anodes of the instant invention.

In a method of electrolytic recovering of zinc using the anodes of the present invention, conventional electrolysis conditions may be employed, namely, a current density of 160 to 630 amp/m$^2$, a temperature of 30° to 46° C., a sulfuric acid concentration in the electrolyte of 165 to 220 g/l and a zinc content in the electrolyte of 40 to 70 g/l.

BRIEF DESCRIPTION OF THE DRAWING

The sole FIGURE of the drawing is a diagram constituting a representational illustration of a cell for the electrolytic recovery of zinc in accordance with the present invention in a very simplified manner.

SPECIFIC DESCRIPTION

In the drawing, which is representational and simplified to show the essential elements of a cell for the electrolytic recovery of zinc, we have shown a tank 10 in which is mounted an anode 11 constituted by the lead alloy of the present invention and cast from this alloy with openings 12 which can provide passages through which electrolyte can circulate if desired. The anode 11 is suspended from a bar 13 into a sulfuric acid electrolyte 14 containing zinc ions. Utilizing a direct current power supply 15, the zinc is deposited upon a conventional cathode 16 suspended from a bar 17.

Specific Examples

EXAMPLE I

A melt is formed of 0.075% by weight strontium, 0.3% by weight silver, balance lead, and is cast into a plate-shape configuration with openings of conventional dimensions for use in a zinc electrowinning tank. The cast body is cooled slowly (over a period of 3 hours) to room temperature and the anode is then utilized in a conventional zinc electrowinning cell at a current density of 450 amp/m$^2$ and a temperature of 40° C. The electrolyte was an aqueous solution of 200 g/l sulfuric acid containing 60 g/l of zinc. After three months of operation, the distortion of the anode was found to be minimal and the loss of weight was also minimal.

EXAMPLE II

An anode was prepared and tested as described in Example I except that 0.075% by weight of calcium was substituted for the strontium with substantially the same results.

We claim:

1. A method of electrolytically recovering zinc from an acid eletrolyte comprising the steps of immersing an anode consisting of essentially 0.1 to 0.5% by weight silver, at least one element selected from the group which consists of 0.05 to 0.25% by weight strontium and 0.05 to 0.1% by weight calcium, balance lead, in said electrolyte and juxtaposing said anode with a cathode; and electrolyzing said electrolyte between said anode and said cathode to deposit zinc on said cathode.

2. The method defined in claim 1 wherein said anode contains 0.05 to 0.1% by weight strontium.

3. The method defined in claim 1, further comprising the steps of forming said anode by casting a plate from a melt consisting essentially of 0.1 to 0.5% by weight silver, at least one element selected from the group which consists of 0.05 to 0.25% by weight strontium and 0.05 to 0.1% by weight calcium, balance lead, and slowly cooling the cast plate.

* * * * *